US007401702B2

(12) United States Patent
Hession

(10) Patent No.: US 7,401,702 B2
(45) Date of Patent: Jul. 22, 2008

(54) CHILD-RESISTANT BLISTER PACKAGE

(75) Inventor: Christopher Hession, Richmond, VA (US)

(73) Assignee: MeadWestvaco Corporation, Glen Allen, VA (US)

( * ) Notice: Subject to any disclaimer, the term of this patent is extended or adjusted under 35 U.S.C. 154(b) by 49 days.

(21) Appl. No.: 11/426,811

(22) Filed: Jun. 27, 2006

(65) Prior Publication Data

US 2006/0289328 A1 Dec. 28, 2006

Related U.S. Application Data

(60) Provisional application No. 60/694,445, filed on Jun. 27, 2005.

(51) Int. Cl.
*B65D 85/42* (2006.01)
*B65B 1/04* (2006.01)

(52) U.S. Cl. ..... 206/531; 206/532; 206/539; 53/467

(58) Field of Classification Search ..... 206/528, 206/530–532, 534, 538, 539; 53/450, 460, 53/467, 469, 473, 475, 476, 485
See application file for complete search history.

(56) References Cited

U.S. PATENT DOCUMENTS 3,899,080 A 8/1975 Brunda
3,912,081 A 10/1975 Haines et al.
3,921,805 A 11/1975 Compere
3,924,746 A 12/1975 Haines
3,924,747 A 12/1975 Gerner
4,125,190 A 11/1978 Davie et al.
4,243,144 A 1/1981 Hargulies
4,506,789 A 3/1985 Diugosz
4,537,312 A * 8/1985 Intini ..... 206/531
5,172,812 A 12/1992 Wharton et al.
5,339,960 A 8/1994 Price
5,758,774 A 6/1998 Leblong
5,878,888 A 3/1999 Faughey
5,944,191 A 8/1999 Ray et al.
6,951,282 B2 10/2005 Jones
6,974,032 B2 * 12/2005 Intini ..... 206/532
2003/0111379 A1 6/2003 Intini
2003/0146125 A1 8/2003 Paliotta et al.
2005/0023180 A1 2/2005 Intini
2006/0138015 A1 6/2006 Freeze
2006/0249420 A1 11/2006 Hession

* cited by examiner

*Primary Examiner*—Luan K Bui

(57) ABSTRACT

A package includes a blank having a face panel and a back panel. The face panel includes apertures and face tabs. The back panel includes gates that correspond with apertures, and tab strips that overlap the gates and are adjoined to back tabs. A blister pack is sealed between the face panel and the back panel whereby blisters align over gates and protrude through apertures, and tabs and form a composite pull tab. To remove an item from a blister, the pull tab is pressed out of the panels, the tab strip is peeled from the back panel, and pressure is applied to force the item through the backing sheet of the blister pack and the exposed gate.

14 Claims, 5 Drawing Sheets

CHILD-RESISTANT BLISTER PACKAGE

CROSS REFERENCE TO RELATED APPLICATIONS

This application claims the benefit of U.S. Provisional Patent Application No. 60/694,445 filed Jun. 27, 2005, the entirety of which is herein incorporated by reference.

FIELD OF INVENTION

The present invention relates to apparatus and methods of packaging and dispensing items, and more specifically, the present invention is directed to a child-resistant package including a blister pack for dispensing items.

BACKGROUND OF THE INVENTION

It is well known to use blister packaging to contain items. Such items may include pharmaceutical tablets, pills, and capsules. Conventional blister packages include a blister tray that is typically a thermo-formed plastic sheet having a plurality of blister cells or depressions formed therein. Typically, after the items are placed in the cells, the items are retained and protected in the cell by securing a backing sheet comprising foil, plastic or a paperboard lid that covers the blister cells. In other types of conventional packages the contents are placed in substantially puncture proof foil containers that are then covered with a foil or paperboard lid.

In conventional packages, the foil is thin enough to be either punctured mechanically or ruptured by pressing the enclosed items against the foil. Typically with paperboard lids, gates are formed in the lid in the general vicinity of the blister cells to assist with removing the contents from the cells. Each gate is deformed or manipulated so that it ruptures or partially separates from the paperboard lid, allowing the item within the blister cell to be pushed through the gate.

While the conventional blister packages are suitable for some applications, there are several design deficiencies. The conventional blister packages provide removal of the items from the blister cells, but offer very little child resistance. Child resistance is a feature that is particularly desired for unit dose pharmaceutical packaging, and is mandated by the Poison Prevention Packaging Act of 1970. Guidelines are prescribed for packaging to satisfy the criteria for child resistance. For example, a child-resistance (CR) rating of F=1 requires that a random sampling of the subject packages not be compromised by an age-specific test pool of children at no greater than a predetermined failure rate. This general guideline is designed to ensure that the package has sufficient integrity against tampering by children.

In addition to a blister package being child-resistant, it is also desirable that the package be senior friendly to permit easy withdrawal of items from the package requiring minimum manipulation even where a user's manual dexterity and strength is reduced.

Accordingly, there remains in the art a need for apparatus and methods of packaging and dispensing items where the package is senior friendly and substantially child-resistant.

SUMMARY OF THE INVENTION

The present invention overcomes the deficiencies of the known art and the problems that remain unsolved by providing a child-resistant package that is inexpensive, easy to fabricate and can be used with conventional blister packs. Generally speaking, the child-resistant package includes a blister pack that is disposed and sealed between two panels. The package includes a tab strip that is associated with a pull tab where the tab strip covers a gate. The gate correspondingly aligns with each blister of a blister pack to additionally secure at least one item within the blister. Pressure is applied to the pull tab to bend the pull tab outwards. The pull tab is pulled to peel the tab strip in order to delaminate the tab strip and expose the gate. Finally, pressure is applied to the corresponding blister to force an item to rupture the backing sheet of the blister pack and to dislodge the gate to gain access to an item. The child-resistant package of the present invention includes security features that require a sequence of coordinated motions including pressing, pulling, and pressing again to gain access to a limited number of items.

In accordance with an exemplary embodiment of the present invention, there is provided a packaging system comprising at least one panel including at least one gate; at least one panel tab and one aperture alignably formed on said panel, on a side opposite from said gate, wherein said aperture corresponds with said gate; at least one tab strip having a strip tab, said tab strip overlapping said gate; a blister pack including at least one blister for holding at least one item, said blister pack being disposed on said panel so that said at least one blister aligns with said gate, and wherein said panel is folded to seal said blister pack, said at least one blister extending through said aperture and said tabs being attached together.

In additional exemplary embodiments of the present invention, there are provided methods of packaging items within a package. One method comprises the steps of: constructing a packaging blank comprising; a face panel including, a face blank, at least one face tab, and at least one aperture corresponding to said face tab; a back panel including, a back blank, at least one gate oppositely aligned with said aperture, and at least one tab strip having a back tab oppositely aligned with said face tab, said tab strip overlapping said gate. Positioning a blister pack on the back panel, said blister pack including a plurality of blisters for holding at least one item, said at least one blister aligning over said gate, and folding said packaging blank for sealing said blister pack between said face panel and said back panel where said at least one blister extends through said aperture, said tabs being sealed together forming a pull tab where said blanks are sealed together forming a cover.

Regarding the embodiments described herein, as well as those covered by the claims, the face panel and back panel may or may not include a tear-resistant layer to provide structural integrity and reinforcement to the child-resistant package. Further, alternative embodiments may include abhesive as a means to permit or control separation and/or delamination of the panel and thus access to the stored item. In addition, the blister pack may or may not comprise a conventional blister pack including at least one blister for holding at least one item. The blister pack may be designed to include any shape or dimension that corresponds with a packaging blank. Further, the terms, "face" and "back" are merely directional in order to distinguish one surface from another. Accordingly, those terms are not limitations but may be used interchangeably. In addition, although full and partial cuts are described herein, it is contemplated that these cuts include perforations comprising a line of short slits, a line of half cuts, a single half cut, and any combination of slits, score lines, and half cuts, or the equivalent, as understood by those skilled in the art.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention. It will be understood that the present invention is applicable to the packaging, storing, and dispensing of various items or products, including but not limited to, tablets, pills, capsules, lozenges, chewables, patches, drug delivery devices, medications, and/or non-medications, liquids and the like. The term "items" as used herein include a unit dose of a pharmaceutical product and all manner of small and portable items or products that a user may wish to keep secure and dispense in a regulated, safe manner.

Figure 1A:
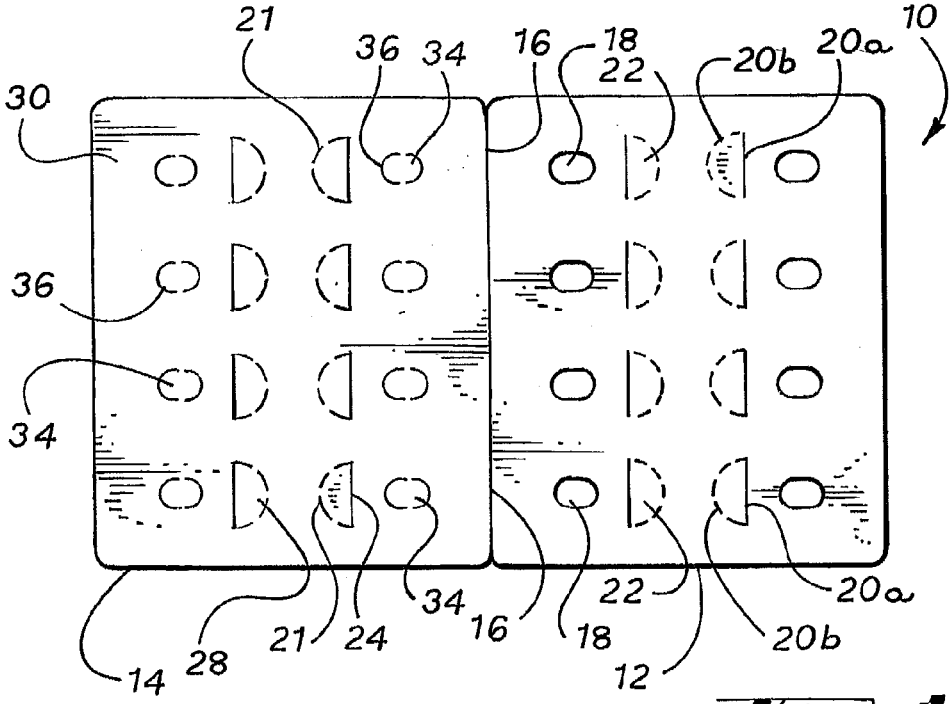
FIG. 1A is a plan view of an inner surface of an exemplary packaging blank, according to the present invention.

Referring now to the drawings, wherein like elements are represented by like numerals, FIG. 1A shows a plan view of an exemplary packaging blank 10, from an interior surface thereof, according to the present invention. The packaging blank 10 is illustrated having a face panel 12 that is integrally hinged with a back panel 14 at foldable score line 16. Although in an exemplary embodiment the face panel 12 and back panel 14 are integrally formed as one piece, it will be understood that the face panel 12 may be separate and distinct from back panel 14.

Figure 1B:
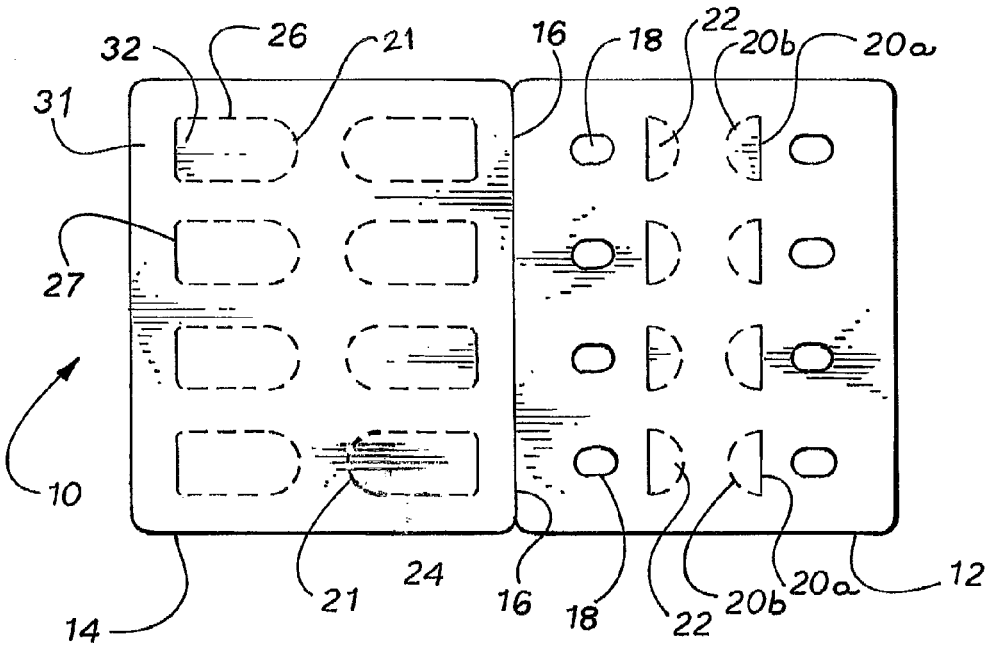
FIG. 1B is a plan view of the reverse side, or outer surface, of the exemplary blank of FIG. 1A, according to the present invention.

The packaging blank 10 can be selected from any suitable substrate material, or combination thereof, to include plastics and conventional paperboard grades, for example solid bleached sulfate (SBS) paperboard ranging in weight, size, and shape. The blank 10 may also be an unbleached board, depending on the desired appearance of the final package. The substrate, if paperboard, is preferably coated on at least one side, with a conventional coating selected for compatibility with the printing method and board composition. The package blank 10 is typically formed so that after folding, the coated side (the outer surface which is shown in FIG. 1B) becomes the external surface of the package. This allows information or directives about the package contents to be viewed without opening the package. For purposes of teaching and directional orientation only, the illustrated embodiments comprise an unprinted side (the inner surface) and a printed side (the outer surface). The unprinted side, that is, the inner surface, is visible in FIG. 1A, while the opposite, outer surface, is the printed side shown in FIG. 1B.

Figure 2:
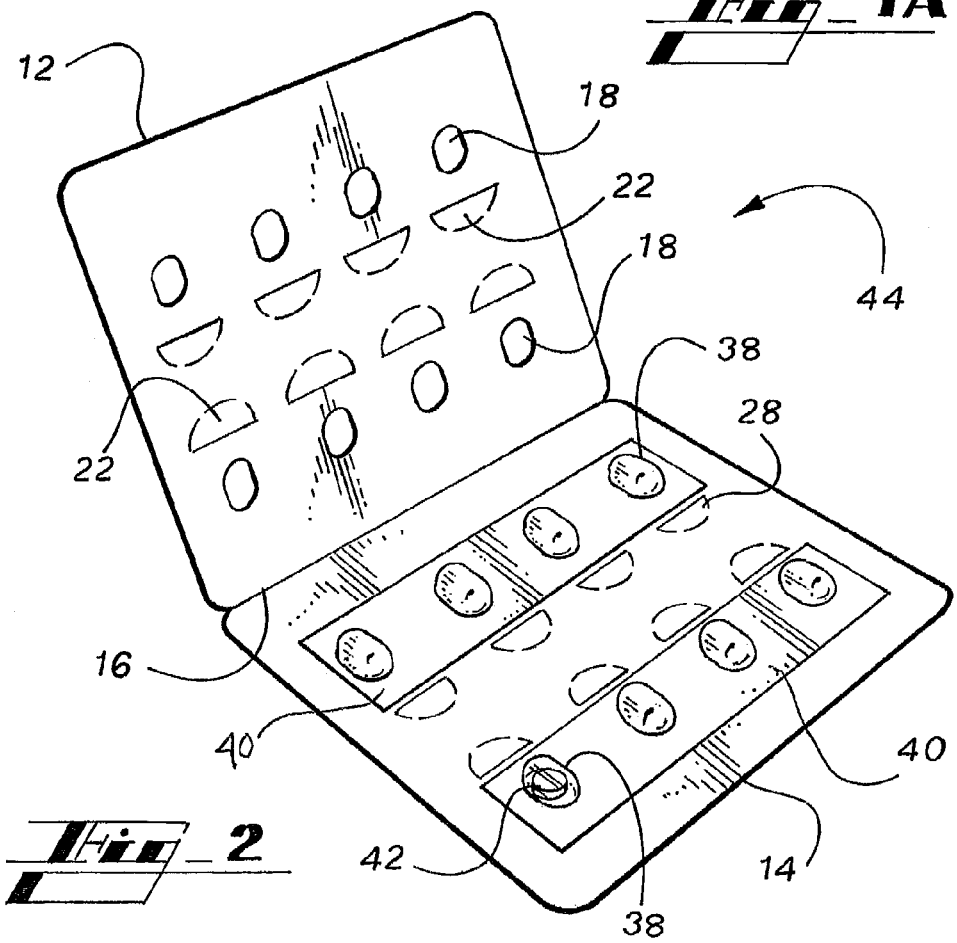
FIG. 2 is a perspective view of an exemplary package showing two panels and a blister pack prior to folding the two panels together, according to the present invention.

As illustrated in FIG. 1A, the face panel 12 includes a plurality of apertures 18 dimensioned and aligned to receive and fit around a corresponding blister 38 of a blister pack 40, best illustrated in FIG. 2. The apertures 18 are dimensionally designed to correspond with the shape and size of blisters 38. The face panel 12 further contains a series of full-depth cuts 20*a*, 20*b* forming a perforated or serrated line, or other frangible or weakened line of severance. Within the scope of the invention, the lower line 20*a* may also be a full, single-cut line. The cuts 20*a*, 20*b* can vary in shape and size, as needed, to form removable face tabs 22. It will be noted that the apertures 18 and face tabs 22 may comprise any layout, size, shape, number and/or dimensions without departing from the scope of the invention.

The inner surface of the back panel 14 includes a series of full-depth cuts 21 forming a perforated or serrated line, or other frangible or weakened line of severance. Partial-depth cuts forming a perforated or serrated line, or other frangible or weakened line of severance, or creases or scores of predetermined depth define a line 24, which together with full-depth cuts 21 form removable back tabs 28. Both cuts and/or lines 21, 24 may be die-cut from the inner surface (unprinted side). The back tabs 28 correspondingly align with the face tabs 22 on face panel 12.

The inner surface of the back panel 14 further includes a plurality of gates 34 that correspondingly align with each aperture 18 on face panel 12. Gates 34 are defined and formed by partial-depth cuts 36 which are die cut on the unprinted side 30 of the back panel 14. As can be comprehended from FIG. 2, each individual gate 34 (not shown) aligns with each corresponding blister 38 and overlaps the backing sheet of the blister pack 40 to additionally secure item 42 within blister 38.

Referring now to FIG. 1B, therein is illustrated an outer surface of the exemplary blank of FIG. 1A. The features of the face panel 12 appear in the same configuration on both sides thereof. Each pair of an aperture 18 and a tab 22 defined by cut lines 20*a*, 20*b* extend through the panel and appear on the outer surface as well as the inner surface. The outer surface of the back panel 14 further includes a series of lines of partial-depth cuts 26 die cut on the printed side 31 of the back panel 14 to define tab strips 32. The partial-depth cuts 26 surround an area around a gate 34 (not seen from this outer surface), as described below. The partial-depth cuts 26 assist the tab strips 32 in delaminating from the back panel 14 consistent with the area occupied within the partial-depth cuts 26 that surround gate 34. Tab strips 32 are associated with back tabs 28 and both tab strips 32 and back tabs 28 are formed from the same back panel 14 material. One end of the tab strip 32 adjoins the back tab 28 that is formed. Thus, what appear as the curved end portions 21 of tab strips 32 are full-dept cuts 21 of the back tab 28. The back tabs 28 and tab strips 32 may be formed as one uniform piece or may comprise separate pieces that are joined together.

The face tab 22 and its associated opening provide a region in the face panel 12 that enables the tab strip 32 to begin to be pushed away from the back panel 14. Further, when affixed to one another, the back tabs 28 and face tabs 22 act as a composite grasping mechanism to assist in tearing or peeling tab strips 32 away from back panel 14. Disposed at the distal end of the illustrated tab strips 32, opposite the curve cut that defines the top of the back tab 28, is a partial-depth cut 27. The invention contemplates that the distal end of the tab strip 32 may include a line 27 defined by a partial-or full-depth cut, or a crease, score or fold line, or no cut or line whatsoever. Thus, tab strips 32 may or may not remain hingeably connected to back panel 14. Each tab strip 32 is dimensioned to overlie a corresponding gate 34. It will be noted that tab strips 32 may comprise a variety of different shapes, sizes or lengths that are designed to selectively determine the area of delamination around gates 34.

A tear-resistant layer may or may not be adhered to packaging blank 10. A tear-resistant layer 13, best shown in FIGS. 10 and 11, may be attached to the unprinted side of face panel 12. Tear-resistant layers are often laminated to the blank before cutting. Some examples of acceptable laminates include Endurance PTHS® and EZ Seal®, both of which are presently available through the Applicant. The tear-resistant layer 13 provides structural integrity in sealing blister pack 40 between face panel 12 and back panel 14. Tear-resistant layer 13 can also be disposed over the backing sheet of the blister package 40 to overlie blisters 38 to provide additional child-resistant security features.

One embodiment of a method of manufacturing the above described blank 10 comprises the cuts being made in one or more passes. In one pass, with the unprinted side (or inner surface) facing a knife or die, partial-depth cuts 24 and 36 are made. Alternative embodiments may substitute partial-depth cut 24 with a crease, score, or similar foldable line. In another pass, or in the same pass but with regard to the printed side facing a knife or die, partial-depth cuts 26 and 27 are made. Full-depth cuts 20*a*, 20*b* and 21, of course, may be made from either side.

FIG. 2 shows a perspective view of an exemplary child-resistant package 44. The package 44 comprises a face panel 12, a blister pack 40, and a back panel 14. The blister pack 40 includes a plurality of blisters 38 that may be arranged in a variety of layouts and/or configurations. At least one blister 38 is dimensioned to hold at least one item 42. In one non-limiting example, a thermoforming technique may be used to fabricate a plastic shell containing one or more blisters 38. The blister pack 40 includes a backing sheet generally comprising a foil, aluminum, plastic or paper layer. The backing sheet is secured to the underside of the blister pack 40 for securely holding at least one item 42 within at least one blister 38. The backing sheet is operable to rupture or otherwise release item 42 upon application of pressure to blister 38. The blister pack 40 may be formed from a plastic, cardboard, paper, or paperboard material or any combination thereof.

In assembly, blister pack 40 is securely disposed or attached on back panel 14. Each blister 38 of the blister pack 40 is aligned with its opening over a respective corresponding gate 34. As illustrated in FIG. 2, face panel 12 is folded along foldable score line 16, and collapsed over blister pack 40 thereby sealing the blister pack 40 between the panels 12, 14. Each blister 38 protrudes through a corresponding aperture 18 of face panel 12. Face tabs 22 are also sealed to back tabs 28 so that full-depth cuts 20*b* correspond with full-depth cuts 21, and full-depth cuts 20*a* correspond with partial-depth cuts or other weakened line of joinder 24. Alternatively, the blister pack 40 may be disposed on face panel 12 so that each blister 38 extends through a corresponding aperture 18. The back panel 14 is folded along foldable score line 16 so that each gate 34 correspondingly aligns with each blister 38. The back panel 14 is sealed to the face panel 12. Face tabs 22 are also sealed to back tabs 28 forming composite pull tabs 46, best shown in FIGS. 3 and 4. The panels 12, 14 may be sealed together by any means known in the art, including but not limited to, an Easy Seal product as presently available through the applicant (and assignee) that is the owner.

Figure 3:
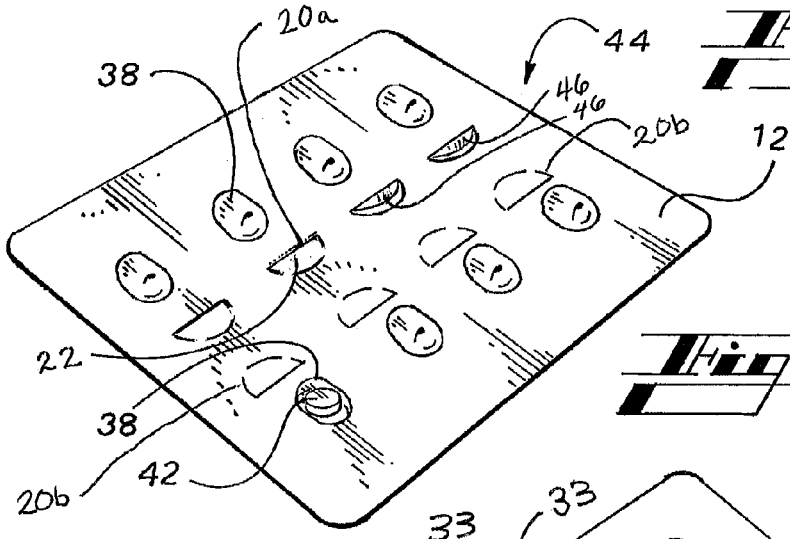
FIG. 3 is a perspective view of an exemplary package, fully-formed, showing pull tabs partially and fully removed, according to the present invention.

FIG. 3 shows a perspective view of the child-resistant package 44. As illustrated in FIG. 2, the face panel 12 has been foldably sealed to the backing panel 14 securing blister pack 40 therein. The blisters 38 of the blister pack 40 protrude through corresponding apertures 18 of face panel 12. The face tabs 22 and back tabs 28 have been sealed together to form pull tabs 46. As shown in FIG. 3, force is applied to disengage a pull tab 46 along the full-depth cuts 20*a*, 20*b*, 21, allowing the pull tab 46 to bend out of plane defined by the face panel 12 and back panel 14.

Figure 4:
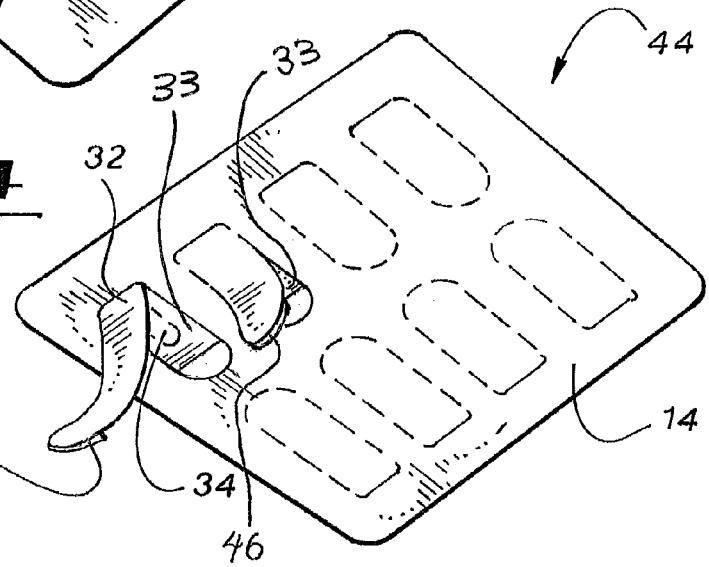
FIG. 4 is a perspective view of an exemplary package showing partially-peeled tab strips, according to the present invention.

FIG. 4 shows a perspective view of the opposite side of the child-resistant package 44. As illustrated in FIG. 3, a user initially applies force to press pull tab 46 so that pull tab 46 bends away from the panels 12, 14. A user then grasps the pull tab 46 and pulls on the pull tab 46, peeling tab strip 32. Tab strip 32 delaminates consistent with the area occupied within the partial-depth cuts 26 that surround the gate area, exposing gate 34 surrounded by deliminated region having a configuration 33 corresponding to that of the peeled-away tab strip 32. As previously discussed, tab strip 32 may or may not remain hingeably attached to back panel 14. After tab strip 32 is lifted or peeled back, the user exerts pressure to the corresponding blister 38. The exerted pressure forces item 42 to rupture or puncture the backing sheet of the blister pack 40. In addition, the pressure forces item 42 to press against gate 34 which forces gate 34 to dislodge from a layer of delaminated panel 14 along partial-depth cuts 36, thereby releasing item 42.

Figure 5:
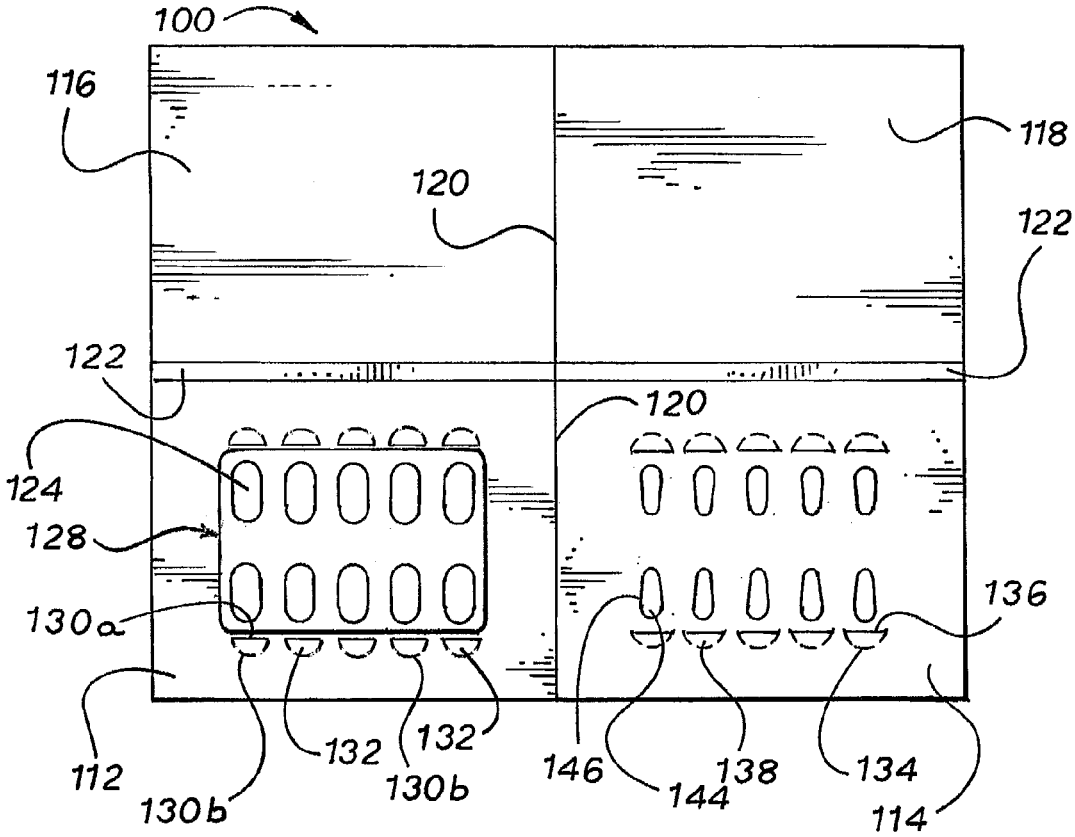
FIG. 5 is a plan view of an exemplary packaging blank, according to the present invention.

Referring to FIG. 5, there is shown a plan view of an exemplary package blank 100 in accordance with the present invention. For purpose of teaching and directional orientation only, the package blank 100 is shown with the printed side (the outer surface) down and the unprinted side (inner surface) up. The packaging blank 100 includes a face panel 112, a back panel 114, a face blank 116 and a back blank 118. The face panel 112 and the face blank 116 are connected to the back panel 114 and the back blank 118, respectively, at foldable score line 120. In addition, the face panel 112 and back panel 114 are connected to the face blank 116 and back blank 118, respectively, along a spine 122 defined by score lines. In the exemplary embodiment, the panels 112, 114 and blanks 116, 118 are integrally formed as one piece. However, the panels 112, 114 and blanks 116, 118 may comprise separate and distinct pieces that are separately attached together.

Again, a tear-resistant layer may or may not be adhered to the blank 100. The tear-resistant layer can be attached to face panel 112, with or without covering apertures 124, or to the back panel 114. If desired, a tear-resistant layer can also be attached to the face blank 116 and back blank 118 also increasing the structural integrity and strength of cover 152 as described below.

Figure 6:
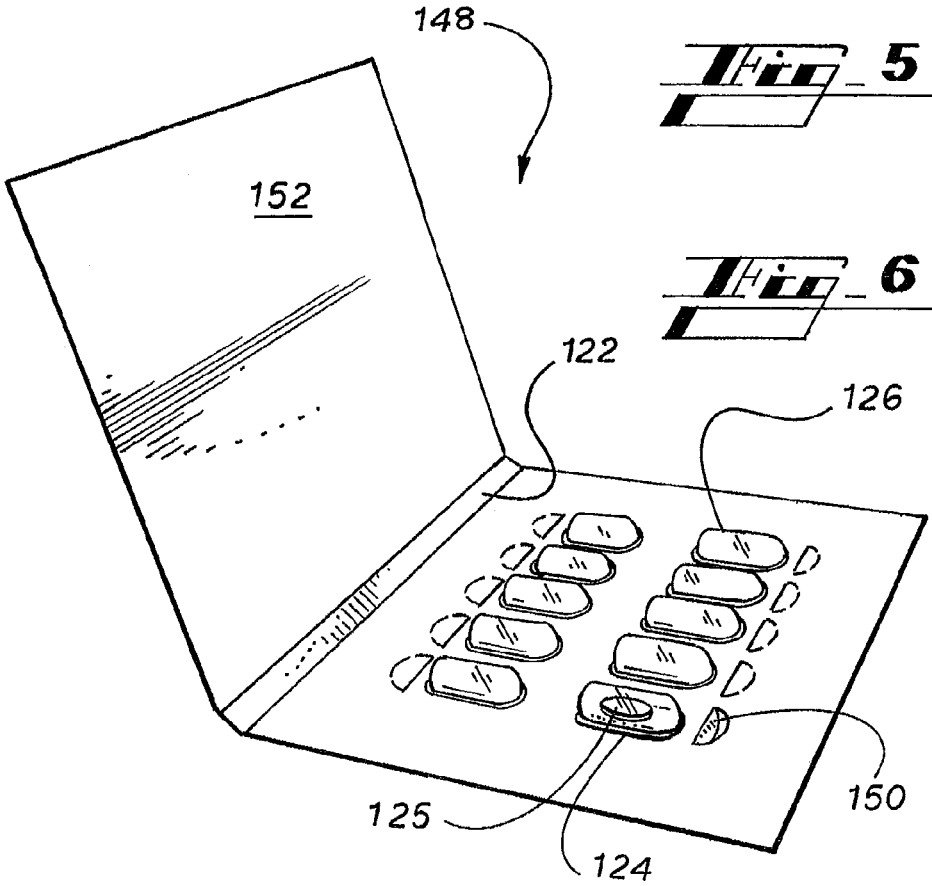
FIG. 6 is a perspective view of an exemplary package including a one-piece, dual-row blister pack and package cover, according to the present invention.

Reference is now made momentarily to both FIG. 5 and FIG. 6. The face panel 112 includes a plurality of apertures 124. The apertures 124 are dimensioned and aligned to receive and fit around corresponding blisters 126 of a blister pack. The apertures 124 may comprise any shape, size or dimension and designed to correspond with the shape and size of blisters 126. The inner surface of the face panel 112 further includes indicia defining a perimeter for a blister pack receiving area 128 for receiving a blister pack of predetermined size and configuration. Referring back to FIG. 5, the face panel 112 further contains a series of full-depth cuts 130*a*, 130*b* forming perforated or serrated lines, or other frangible or weakened lines of severance that can vary in shape and size, as needed, to form removable face tabs 132. Although face tabs 132 are shown in a semi-circular shape, it will be noted that other shapes may be used without departing from the scope of the invention.

The back panel 114 includes a series of full-depth cuts 134 forming a perforated or serrated line, or other frangible or weakened line of severance. Partial-depth cuts forming a perforated or serrated line, or other frangible or weakened line of severance, or creases or scores of predetermined depth define a line 136. Both lines 134, 136 are cut or otherwise formed on the unprinted side (inner surface) of the back panel 114, forming removable back tabs 138 each having a hinge. Alternative embodiments may substitute partial-depth cut 136 with a crease, score, or similar foldable line. The back tabs 138 correspondingly align with the face tabs 132 on face panel 112.

The outer surface (not shown) of the back panel 114 further includes a series of lines of partial-depth cuts that are die cut on the printed side (outer surface) of the back panel 114 defining tab strips in the same manner as previously illustrated and described with respect to the exemplary blanks and packages of FIGS. 1-4. The partial-depth cuts surround an area around gates 144, as described below. The partial-depth cuts assist tab strips to delaminate from back panel 114 consistent with the area occupied within the partial-depth cuts that surround gates 144. In an exemplary embodiment, tab strips are associated with back tabs 138 and formed from the same panel material. Each back tab 138 and each tab strip may be formed as one uniform piece or may comprise separate pieces that are joined together. Tab strips may or may not be hingeably connected to back panel 114. It will be noted that tab strips may comprise a variety of different shapes or sizes designed to selectively control the extent of the area that is delaminated from backing panel 114.

The back panel 114 includes a plurality of gates 144 that correspondingly align with each aperture 124 of face panel 112. Gates 144 are defined and formed by partial-depth cuts 146 which are die cut on the unprinted side (inner surface) of the back panel 114. As illustrated in FIG. 6, each individual gate 144 correspondingly aligns with a blister 126 and overlaps the backing sheet of the blister pack to additionally secure item 125 within blister 126.

The back panel 114 includes a plurality of gates 144 that correspondingly align with each aperture 124 of face panel 112. Gates 144 are defined and formed by partial-depth cuts 146 which are die cut on the unprinted side (inner surface) of the back panel 114. As illustrated in FIG. 6, each individual gate 144 correspondingly aligns with a blister 126 and overlaps the backing sheet of the blister pack to additionally secure item 125 within blister 126.

Referring to FIG. 6, there is shown a perspective view of an exemplary child-resistant package 148 formed from the blank of FIG. 5. In assembly, a blister pack is disposed in the blister pack receiving area 128 on face panel 112. Each individual blister 126 extends through a corresponding aperture 124. The back panel 114 and back blank 118 are folded along the score line 120 and sealed to face panel 112 and face blank 116, respectively, sealing the blister pack between face panel 112 and the back panel 114. Each gate 144 on the back panel 114 overlies the backing sheet of a corresponding blister 126. Full-depth cuts 130*b* correspondingly align with full-depth cuts 134. The face tabs 132 are sealed to back tabs 138 forming composite pull tabs 150.

Back blank 118 is folded over and sealed to face blank 116 forming cover 152. Cover 152 is folded along the score lines of spine 122 as covering for the sealed blister pack. It will be understood that the face panel 112, face blank 116, back panel 114 and back blank 118 may be sealed by any means known in the art, including but not limited to, an Easy Seal® or Easy Seal® Plus product.

As shown in FIG. 6, when force is applied to dislodge pull tab 150, the pull tab 150 disengages along full-depth cuts 130*a*, 130*b*, 134 and rotates out of the plane defined by face panel 112 and back panel 114. Pull tab 150 extends outward for easy access.

In practice, a user grasps pull tab 150 and peels a corresponding tab strip away from back panel 114. In the same manner as previously illustrated and described with respect to the exemplary blank and package of FIGS. 1-4, the tab strip delaminates consistent with the area occupied within the partial-depth cuts that surround the gate area, exposing gate 144. To remove an item 125, pressure is exerted on a corresponding blister 126, forcing item 125 to rupture or puncture the backing sheet of the blister pack. The applied pressure also forces item 125 to press against gate 144 to dislodge gate 144 along the partial-depth cuts 146, allowing access to item 125.

An exemplary method of manufacturing the above described blank 100 comprises combining certain cuts and making those cuts in one pass. Here, with the unprinted side facing a knife or die, partial-depth cut 136 may be substituted with a crease, score, or similar foldable line of joinder. Thereafter, the full-depth cuts 130*a*, 130*b* partial-depth cut 146, and cut or foldable line 136 may all be made in the same pass.

Figure 7:
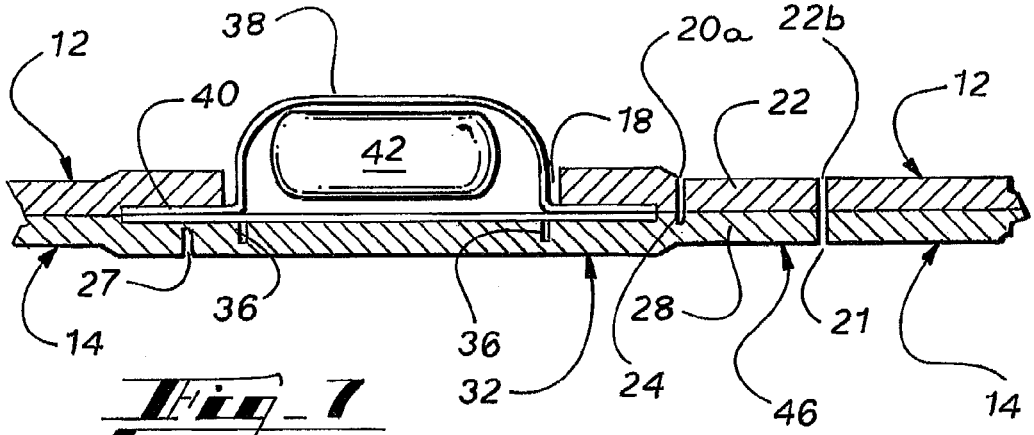
FIGS. 7-9 are cross-sectional views of an exemplary package, according to the present invention.
Figure 8:
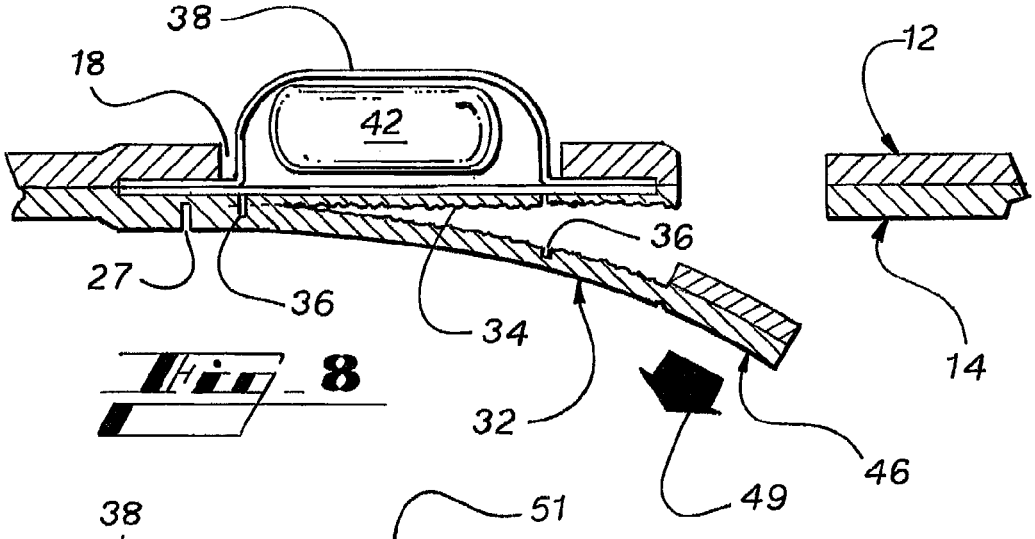
Figure 9:
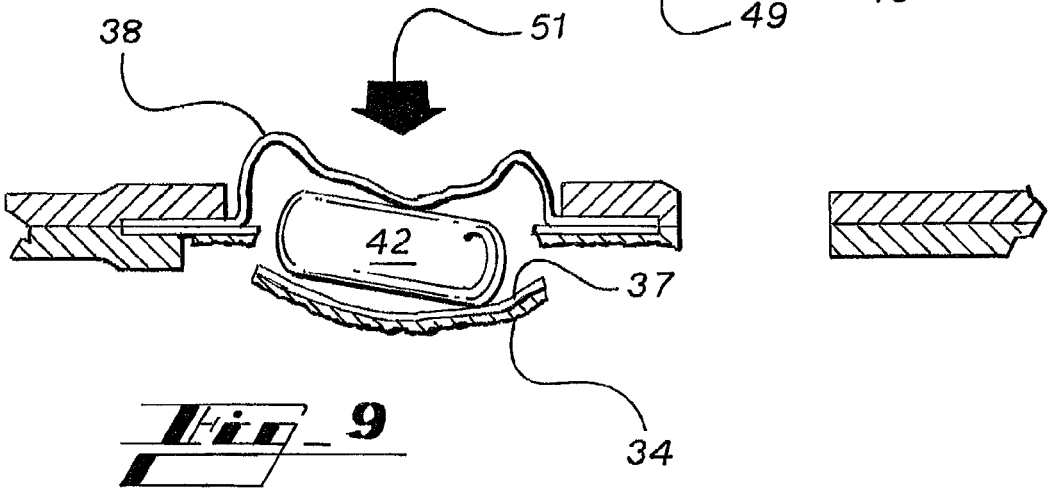

Referring now to FIGS. 7-9 there are shown cross-section views of the exemplary child-resistant package 44, as illustrated in FIG. 3. FIG. 7 shows a face panel 12 sealed to back panel 14 for enclosing blister pack 40. Blister 38 protrudes through aperture 18 of the face panel 12. At least one item 42 is enclosed in blister 38. Tab strip 32 is formed within backing panel 14 and correspondingly overlies blister 38. Face tab 22 is correspondingly sealed to back tab 28 forming composite, removable pull tab 46. Full-depth cut 20*a* extends through face panel 12. The depth of the partial-depth cut or otherwise formed line of demarcation 24 of the lower edge of the back tab 28 controls the degree of delamination of tab strip 32 when the tab strip 32 is peeled back. As understood by those skilled in the art, the amount of delamination may vary depending on the type of material used. Further, a tear-resistant layer may not delaminate at all, but rather hold the tab strip together.

As previously described, there can be located at the distal end of the tab strip 32 a line 27 of selected various construction (full-depth cut, partial-dept cut, score, crease, no line) that extends through the printed side of back panel 14. The line 27 as a full-depth cut allows the tab strip 32 to be hingeably removed from back panel 14. On the other hand, when the line 27 at the distal end of the tab strip 32 comprises a partial-depth cut that extends partially through the printed side of back panel 14, the tab strip 32 is thereby hingeably secured to back panel 14. Further illustrated are partial-depth cuts 36 that extend partially through the unprinted side (inner surface) of the back panel 14 defining a gate 34. The partial-depth cuts 36 may also extend partially into a portion of tab strip 32.

To gain access to item 42, pull tab 46 is pressed outward and pulled in the direction of arrow 49, peeling tab strip 32 away from back panel 14, as illustrated in FIG. 8. Tab strip 32 delaminates from the backing panel 14 layer exposing the corresponding gate 34. The amount of delamination is typically controlled by the depth of the line (cut or crease/score) 24.

As shown in FIG. 9, pressure is applied to blister 38 in the general direction of arrow 51. The applied pressure forces item 42 to rupture the backing sheet 37 that is secured to the underside of blister 38. The applied pressure forces the item 42 to dislodge gate 34 at partial-depth cuts 36, thereby releasing item 42.

Figure 10:
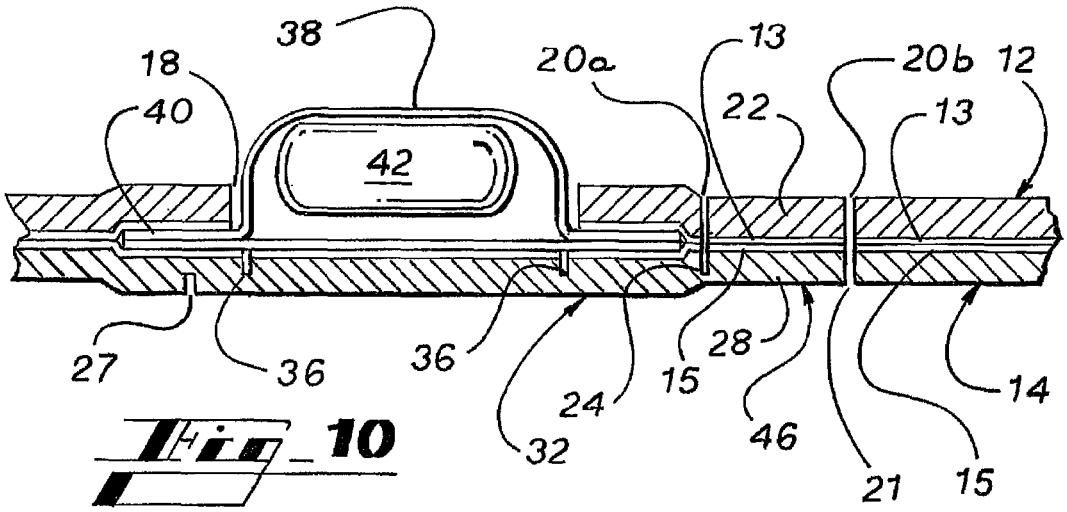
FIGS. 10-12 are cross-sectional views of an exemplary package including tear-resistant layers, according to the present invention.
Figure 11:
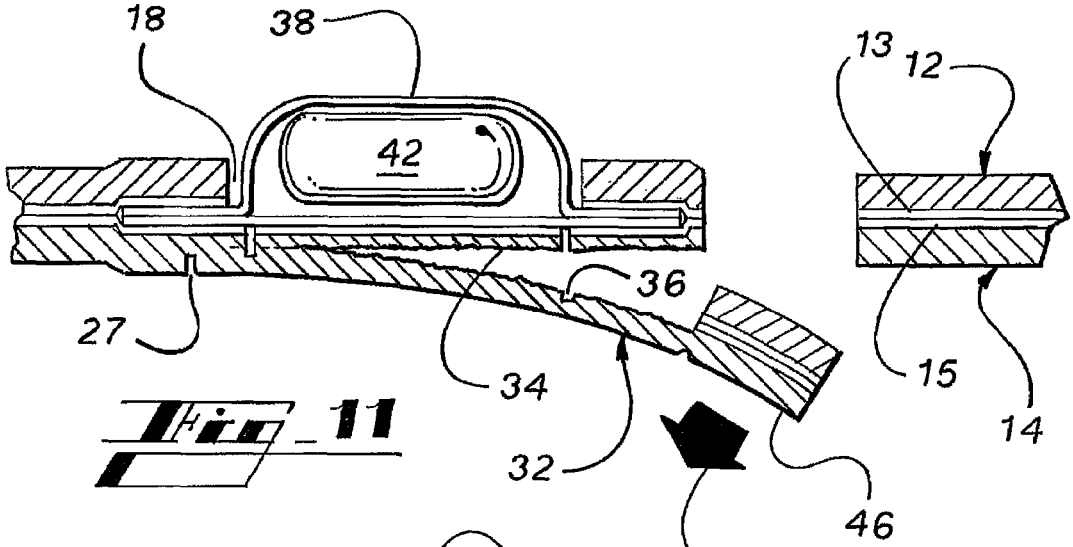
Figure 12:
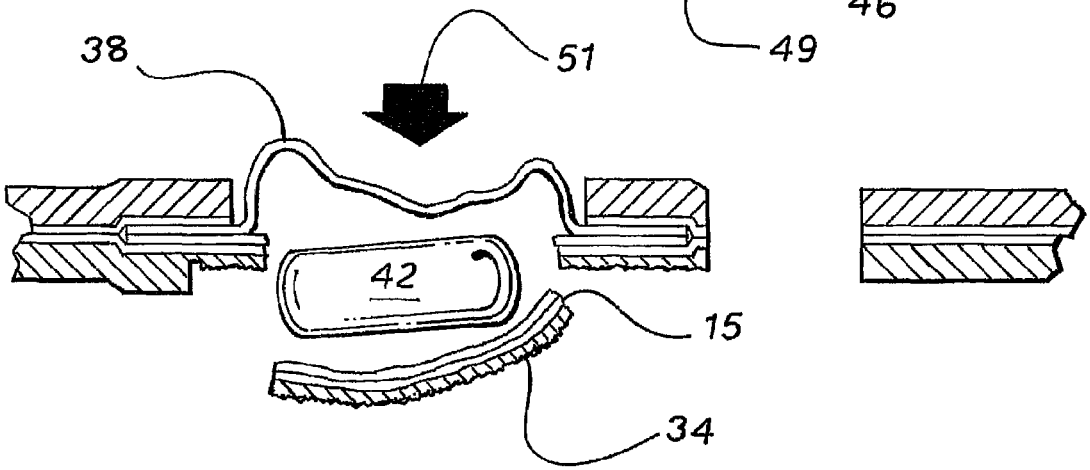

With reference now to FIGS. 10, 11 and 12, there are shown cross-section views of an exemplary child-resistant package like that discussed immediately above with respect to FIGS. 7, 8, and 9. FIG. 10 shows a face panel 12 attached to a first tear-resistant layer 13 and a back panel 14 attached to a second tear-resistant layer 15. A blister pack 40 is disposed between face panel 12 and the first tear-resistant layer 13 and back panel 14 and the second tear-resistant layer 15. The tear-resistant layers 13, 15 provide enhanced structural integrity for sealing blister pack 40 between the face panel 12 and the back panel 14.

As shown, blister 38 protrudes through aperture 18 of face panel 12 and dimensioned to hold at least one item 42. Face tab 22 is also attached to tear-resistant layer 13 and back tab 28 is attached to tear-resistant layer 15. Face tab 22 is sealed to back tab 28 via the tear-resistant layers 13, 15. The sealed face tab 22 and back tab 28 define composite, removable pull tab 46. The full-depth cuts 20*a*, 20*b* extend fully through panels 12, 14 and tear-resistant layers 13, 15. The full-depth cut 20*a* and partial-depth cut, creased/scored or similarly formed line 24 respectively extend through face panel 12 and tear-resistant layers 13, 15, and further extend partially through the unprinted side of back panel 14. Tab strip 32 is formed within back panel 14 and is associated with back tab 28. Tab strip 32 correspondingly overlies an opening to blister 38.

As shown, partial-depth cuts 36 extend through tear-resistant layer 15 and partially through the unprinted side of back panel 14. Located at the distal end of the tab strip 32 is a line that is shown here as a partial-depth cut 27 extending partially through the printed side of back panel 14. The depths of cuts 20*a* and 24 control the degree of delamination when peeling tab strip 32 from back panel 14.

As described previously, to gain access to item 42, pull tab 46 is pressed outward and pulled in the direction of arrow 49. Tab strip 32 is then peeled away from back panel 14. Tab strip 32 delaminates from back panel 14 exposing gate 34. Depending on the selected depths of depth cuts 36, a predetermined, desired portion of the back panel 14 remains attached to the underside of blister 38 when tab strip 32 has delaminated from back panel 14.

As illustrated in FIG. 12, pressure is exerted on blister 38 in the general direction of arrow 51. The exerted pressure forces item 42 to rupture the backing sheet 37 secured to the underside of blister 38. The pressure also forces the item 42 to dislodge a portion of the tear-resistant layer 15 and the gate 34 along partial-depth cuts 36.

In alternative embodiments abhesive—a term used generally to include any and all release compounds and/or mixtures that facilitate the separation of attached panels, layers of panels, or panel plys, can be included as determined by design criteria. For example, abhesive may be used in combination with a tear strip or gate to control the delamination of the tear strips described herein.

As illustrated, the child-resistant package of the present invention includes a variety of security features. Initially, force is applied to press pull tab 46 out of plane with face panel 12 and back panel 14. Subsequently, the pull tab 46 is pulled to peel the tab strip 32 so as to delaminate the tab strip 32 from the back panel 14 in order to expose gate 34. Finally, pressure is applied to the blister 38 to force an item 42 to rupture the backing sheet 37 of the blister pack 40 and to dislodge the gate 34 from the partial-depth cuts 36 thereby releasing item 42.

The invention increases child-resistance capability while still providing a senior-friendly package. Added layers of substrate inhibit access to a blister pack by a child, but, on the other hand, all layers are easily accessed by a more mature or sophisticated user, such as a senior individual, that is able to comprehend and carry out the series of opening requirements. The invention contemplates that the degree of child resistance and the degree of delamination can be varied in direct proportion to the depths of various partial-depth cuts 26, 36.

Alternative exemplary embodiments of the present invention include methods of packaging items or products within a child-resistant package 44. One method includes the steps of constructing a package blank 10 having a face panel 12 and a back panel 14. The method further includes the steps of forming at least one face tab 22 and at least one aperture 18 on the face panel 12, the aperture 18 correspondingly aligning with face tab 22. The method further includes the steps of forming, on the back panel 14, at least one tab strip 32 having a back tab 28, and a gate 34, where the tab strip 32 is dimensioned to overlie the gate 34.

The method further includes the steps of positioning a blister pack 40 on the back panel 14 wherein at least one blister 36 aligns with a gate 34. The method further includes sealing the face panel 12 and the back panel 14 for securely enclosing blister pack 40, where at least one blister 36 protrudes through a corresponding aperture 18 and wherein face tab 22 is sealed to back tab 28 forming push tab 46.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Many combinations and variations of combinations may be made to the above-described embodiments without departing from the scope of the claims. All such combinations and variations of combinations are included herein by the scope of this disclosure and the following claims.

I claim:

1. A blank for forming a package for use with a blister pack, the blank comprising:

a back panel comprising:

at least one gate formed at a first face of the back panel, and through a partial depth of the back panel; and at least one tab strip located in an at least partially overlying stacked relation with the at least one gate, the at least one tab strip being removably formed at a second face of the back panel, and through a partial depth of the back panel, wherein the at least one tab strip is lifted away from the second face leaving a delaminated first configuration, leaving a corresponding delaminated second configuration that includes the at least one gate; and a face panel comprising:

at least one blister aperture; and at least one removable face tab, the at least one removable face tab being at least partially severable from the face panel and corresponding to the at least one aperture; wherein when the first surface of the back panel and the face panel are placed in flat-face condition with respect to one another, the at least one aperture is at least partially aligned with the at least one gate; and a force is exerted upon the at least one removable face tab to urge the at least one tab strip away from the second face of the back panel.

2. The blank of claim 1, wherein the back panel further comprises at least one removable back tab operably connected to at least one tab strip and with the at least one removable face tab of face panel.

3. The blank of claim 1, wherein the at least one removable face tab is completely severable from the face panel.

4. The blank of claim 2, wherein the at least one removable face tab is completely severable from the face panel, and operates with the at least one removable back tab to facilitate grasping of the at least one tab strip.

5. A child-resistant blister package comprising:

a blister pack comprising at least one blister and at least one corresponding blister opening;

a back panel comprising:

at least one gate corresponding to a respective at least one blister opening, the at least one gate being removably formed at a first face of the back panel, and through a partial depth of the back panel; and at least one tab strip, corresponding to the at least one gate, removably formed at a second face of back panel, and a face panel comprising:

at least one blister aperture for receiving the respective at least one blister; and at least one removable face tab, the at least one removable face tab being at least partially severable from the face panel such that when a force is exerted upon the at least one removable face tab, the force at least partially severs the at least one removable face tab and urges the at least one tab strip at least partially away from the second face of the back panel; wherein the blister pack is placed between the face panel and the back panel in a stacked relation during assembly of the child-resistant blister package.

6. The child-resistant package blister package of claim 5, wherein the back panel further comprises at least one removable back tab operably connected to the at least one tab strip and to at least one removable face tab.

7. The child-resistant blister package of claim 6, wherein the at least one removable face tab is completely severable from the face panel.

8. The child-resistant blister package of claim 6, wherein the at least one removable face tab is completely severable from the face panel, and operates with the removable back tab to facilitate grasping of the tab strip.

9. The child-resistant blister package of claim 5, wherein the back panel and the face panel are foldably adjoined to one another.

10. A method of forming a child-resistant package, the method comprising:

providing a blister pack, a back panel, and a front panel, wherein:

the blister pack comprises at least one blister and at least one blister opening;

the back panel comprises:

at least one gate, the at least one gate corresponding to at least one blister opening, and the at least one gate is formed at a first face of the back panel, and through a partial depth of the back panel;

at least one removable back tab formed in the back panel; and at least one tab strip corresponding to and attached to the at least one removable back tab, the at least one tab strip being removably formed at a second face of the back panel and formed through a partial depth of the back panel, wherein:

when the at least one tab strip is lifted away from the second face, the at least one tab strip delaminates the back panel leaving at least a portion of the second face intact, the portion of the second face comprising at least a portion of the at least one gate; and the face panel comprises:

at least one aperture for receiving at least one blister, and at least one region corresponding to the at least one aperture defining a region at which a force may be exerted at the face panel to urge the at least one tab strip away from the second face of the back panel; and affixing the blister pack between the back panel and the face panel.

11. The method of forming the child-resistant package of claim 10, wherein the back panel includes at least one removable back tab to facilitate grasping and adjoining respective the at least one tab strip disposed for coincident alignment with the at least one region of the face panel.

12. The method of forming the child-resistant package of claim 10, wherein the at least one region comprises a removable face tab.

13. The method of forming the child-resistant package of claim 11, wherein the at least one region comprises a removable face tab.

14. The method of forming the child-resistant package of claim 10, wherein the back panel and the face panel are foldably adjoined to one another.

* * * * *